US006887056B2

(12) United States Patent
Hosono

(10) Patent No.: US 6,887,056 B2
(45) Date of Patent: May 3, 2005

(54) OIL PUMP ROTOR

(75) Inventor: Katsuaki Hosono, Niigata (JP)

(73) Assignee: Mitsubishi Materials Corporation, Tokyo (JP)

( * ) Notice: Subject to any disclaimer, the term of this patent is extended or adjusted under 35 U.S.C. 154(b) by 100 days.

(21) Appl. No.: 10/375,326

(22) Filed: Feb. 27, 2003

(65) Prior Publication Data

US 2003/0165392 A1 Sep. 4, 2003

(30) Foreign Application Priority Data

Mar. 1, 2002 (JP) ..... 2002-056476
Mar. 1, 2002 (JP) ..... 2002-056478

(51) Int. Cl.[7] ..... F04C 2/00
(52) U.S. Cl. ..... 418/150; 418/171
(58) Field of Search ..... 418/171, 166, 418/150

(56) References Cited

U.S. PATENT DOCUMENTS 2,994,277 A * 8/1961 Merritt ..... 418/150
4,504,202 A * 3/1985 Saegusa ..... 418/150
5,135,373 A 8/1992 Cozens
5,163,826 A * 11/1992 Cozens ..... 418/150
5,226,798 A * 7/1993 Eisenmann ..... 418/171
6,244,843 B1 * 6/2001 Kosuge ..... 418/150

FOREIGN PATENT DOCUMENTS

DE 3938346 C * 4/1991 ..... F01M/1/02
EP 0552443 A1 7/1993
EP 0779432 A1 6/1997
EP 0785360 A1 7/1997
EP 0870926 A1 10/1998
EP 1016784 A1 7/2000
GB 0233423 * 5/1925 ..... 418/171

OTHER PUBLICATIONS

"Cycloidal Generating Gears of the Working Elements of Positive–Displacement Rotor Machines and their Engagement Factors" Soviet Engineering Research. (Stanki I. Instrumentry & Vestnik Mashinostroenia Mashinostrocnie), Allerton Press, New York, U.S., vol. 11, No. 9, 1991, pp 16–21, XP000292913.

* cited by examiner

*Primary Examiner*—Theresa Trieu
(74) *Attorney, Agent, or Firm*—Darby & Darby

(57) ABSTRACT

An oil pump emits less noise by properly forming the profiles of teeth of an inner rotor and an outer rotor thereof which engage each other, whereby decreasing sliding resistance and rattle between the tooth surfaces of the rotors. The rotors of the oil pump are formed so the inner rotor having "n" teeth is formed such that the tooth tip profile and tooth space profile thereof are formed using cycloid curves which are formed by rolling a first circumscribed-rolling circle and a first inscribed-rolling circle along a base circle, respectively, and the outer rotor having "n+1" teeth is formed such that the tooth tip profile and tooth space profile thereof are formed using cycloid curves which are formed by rolling a second circumscribed-rolling circle and a second inscribed-rolling circle along a base circle, respectively, and in such a manner that the following equations are satisfied: øBo=øBi; øDo=øDi·(n+1)/n+t·(n+1)/(n+2); and øAo=øAi+t/(n+2).

4 Claims, 9 Drawing Sheets

OIL PUMP ROTOR

BACKGROUND OF THE INVENTION

1. Field of the Invention

This invention relates to an oil pump rotor assembly used in an oil pump which draws and discharges fluid by volume change of cells formed between an inner rotor and an outer rotor.

2. Background Art

A conventional oil pump comprises an inner rotor having "n" external teeth (hereinafter "n" indicates a natural number), an outer rotor having "n+1" internal teeth which are engageable with the external teeth, and a casing in which a suction port for drawing fluid and a discharge port for discharging fluid are formed, and fluid is drawn and is discharged by rotation of the inner rotor which produces changes in the volumes of cells formed between the inner rotor and the outer rotor.

Each of the cells is delimited at a front portion and at a rear portion as viewed in the direction of rotation by contact regions between the external teeth of the inner rotor and the internal teeth of the outer rotor, and is also delimited at either side portions by the casing, so that an independent fluid conveying chamber is formed. Each of the cells draws fluid as the volume thereof increases when the cell moves over the suction port after the volume thereof is minimized in the engagement process between the external teeth and the internal teeth, and the cell discharges fluid as the volume thereof decreases when the cell moves over the discharge port after the volume thereof is maximized.

Oil pumps having the above structure are widely used as pumps for lubrication oil in automobiles and as an oil pump for automatic transmissions, etc., since such oil pumps are compact and are simply constructed. When such an oil pump is installed in a vehicle, the oil pump is, for example, driven by the engine of the vehicle in such a manner that the inner rotor of the pump is directly connected to the crankshaft of the engine, which is known as "crankshaft direct drive".

In such an oil pump, a tip clearance having appropriate size is formed between the tooth tip of the inner rotor and the tooth tip of the outer rotor when the inner and outer rotors are in a phase rotated by 180 degrees from a phase in which the inner and outer rotors engage each other in order to reduce pump noise and to increase mechanical efficiency.

As examples of methods for forming a tip clearance, the profiles of the teeth of the outer rotor may be uniformly cut so as to form clearance between the surfaces of the teeth of the inner and outer rotors and so as to form a tip clearance between the tips of the teeth of the inner and outer rotors in an engagement state, or alternatively, the cycloid curve defining the shape of the teeth may be partially flattened.

Next, conditions, which must be satisfied when the profiles of the teeth of the inner and outer rotors are determined, will be explained below.

With regard to the inner rotor ri, because the sum of the rolling distance of a first circumscribed-rolling circle ai (whose diameter is øai) and the rolling distance of a first inscribed-rolling circle bi (whose diameter is øbi) must be closed when each of the rolling circles completes rolling along a base circle, i.e., the length of circumference of a base circle di (whose diameter is ødi) of the inner rotor ri must be equal to the length obtained by multiplying the sum of the rolling distance per revolution of the first circumscribed-rolling circle ai and the rolling distance of the first inscribed-rolling circle bi by an integer (i.e., by the number of teeth of the inner rotor ri), $$\varnothing di=n\cdot(\varnothing ai+\varnothing bi).$$

Similarly, with regard to outer rotor ro, the length of circumference of a base circle "do" (whose diameter is ødo) of the outer rotor ro must be equal to the length obtained by multiplying the sum of the rolling distance per revolution of a second circumscribed-rolling circle ao (whose diameter is øao) and the rolling distance of a second inscribed-rolling circle bo (whose diameter is øbo) by an integer (i.e., by the number of teeth of the outer rotor ro), $$\varnothing do=(n+1)\cdot(\varnothing ao+\varnothing bo).$$

Here, because the inner rotor ri and the outer rotor ro must engage each other, assuming that an eccentric distance between two rotors is "e", $$\varnothing ai+\varnothing bi=\varnothing ao+\varnothing bo=2e.$$

Based on the above equations,
(n+1)·ødi=n·ødo, which must be satisfied when the profiles of the inner rotor ri and outer rotor ro are determined.

Here, in order to allocate a clearance (=s) to a clearance between a tooth space and a tooth tip in an engagement phase and to another clearance between the tips (a tip clearance) in a phase rotated by 180 degrees from the engagement phase, the first and second circumscribed-rolling circles and the first and second inscribed-rolling circles are formed so as to satisfy the following equations:

$$\varnothing ao=\varnothing ai+s/2;\text{and}$$

$$\varnothing bo=\varnothing bi-s/2.$$

More specifically, by increasing the diameter of the circumscribed-rolling circle of the outer rotor, as shown in FIG. 8, a clearance of s/2 is formed between the tooth space of the outer rotor ro and the tooth tip of the inner rotor ri in the engagement phase. On the other hand, by decreasing the diameter of the inscribed-rolling circle of the inner rotor, as shown in FIG. 9, a clearance of s/2 is formed between the tooth space of the inner rotor ri and the tooth tip of the outer rotor ro in the engagement phase.

The oil pump rotor assembly formed such that the above equations are satisfied are shown in FIGS. 7 to 9. Dimensions in the oil pump rotor assembly are as follows:

ødi (the diameter of the base circle di of the inner rotor ri)=52.00 mm; øai (the diameter of the first circumscribed-rolling circle ai)=2.50 mm; øbi (the diameter of the first incribed-rolling circle bi)=2.70 mm; the number of teeth Zi=n=10; the outer diameter of the outer rotor ro is 70 mm; ødo (the diameter of the base circle "do" of the outer rotor ro)=57.20 mm; øao (the diameter of the second circumscribed-rolling circle ao)=2.56 mm; øbo (the diameter of the second incribed-rolling circle bo)=2.64 mm; the number of teeth Zo=n+1=11; and the eccentric distance "e"=2.6 mm.

As shown in FIGS. 8 and 9, between the external teeth of the inner rotor and the internal teeth of the outer rotor, there are provided not only a radial clearance of s1 at the middle points of the tooth tip and the tooth space but also a circumferential clearance of s2 at the vicinity of the intersecting point of the base circles and the tooth surfaces.

If a clearance of "s" is formed by properly selecting the diameter of the second circumscribed-rolling circle ao and the diameter of the second incribed-rolling circle bo while setting the radial clearance s1 to be s/2, the circumferential clearances s2 become large as shown in FIGS. 8 and 9, and as a result, rattle and tooth surface slip between the inner rotor and the outer rotor are increased; therefore, problems are encountered in that loss in transmission torque is increased, heat is generated, and noise is emitted due to continual impacts between the rotors.

SUMMARY OF THE INVENTION

Based on the above problems, an object of the present invention is to reduce noise emitted from an oil pump by properly forming the profiles of teeth of an inner rotor and an outer rotor thereof which engage each other, whereby decreasing sliding resistance and rattle between the tooth surfaces of the rotors.

In order to achieve the above object, an oil pump assembly of a first aspect of the present invention comprises: an inner rotor having "n" external teeth; and an outer rotor having (n+1) internal teeth which are engageable with the external teeth, wherein the oil pump rotor assembly is used in an oil pump which further includes a casing having a suction port for drawing fluid and a discharge port for discharging fluid are formed, and which conveys fluid by drawing and discharging fluid by volume change of cells formed between the inner rotor and the outer rotor produced by relative rotation between the inner rotor and the outer rotor engaging each other, wherein each of the tooth profiles of the inner rotor is formed such that the tooth space profile thereof is formed using an epicycloid curve which is formed by rolling a first circumscribed-rolling circle (Ai) along a base circle (Di) without slip, and the tooth space profile thereof is formed using a hypocycloid curve which is formed by rolling a first inscribed-rolling circle (Bi) along the base circle (Di) without slip, and each of the tooth profiles of the outer rotor is formed such that the tip profile thereof is formed using an epicycloid curve which is formed by rolling a second circumscribed-rolling circle (Ao) along a base circle (Do) without slip, and the tip profile thereof is formed using a hypocycloid curve which is formed by rolling a second inscribed-rolling circle (Bo) along the base circle (Do) without slip, and wherein the inner rotor and the outer rotor are formed such that the following equations are satisfied:

$$\varnothing Bo=\varnothing Bi;$$

$$\varnothing Do=\varnothing Di\cdot(n+1)/n+t\cdot(n+1)/(n+2); \text{ and}$$

$$\varnothing Ao=\varnothing Ai+t/(n+2),$$

where øDi is the diameter of the base circle of the inner rotor, øAi is the diameter of the first circumscribed-rolling circle (Ai), øBi is the diameter of the first inscribed-rolling circle (Bi), øDo is the diameter of the base circle of the outer rotor, øAo is the diameter of the second circumscribed-rolling circle (Ao), øBo is the diameter of the second inscribed-rolling circle (Bo), and t (≠0) is gap between the tooth tip of the inner rotor and the tooth tip of the outer rotor.

More specifically, when tooth profiles of the inner and outer rotors are determined, because the sum of the rolling distances of the circumscribed-rolling circle and the inscribed-rolling circle of the inner rotor must be equal to the circumferential length of the base circle thereof, and the sum of the rolling distances of the circumscribed-rolling circle and the inscribed-rolling circle of the outer rotor must be equal to the circumferential length of the base circle thereof, the following equations must be satisfied:

$$\varnothing Di=n\cdot(\varnothing Ao+\varnothing Bo); \text{ and}$$

$$\varnothing Do=(n+1)\cdot(\varnothing Ao+\varnothing Bo).$$

In addition, in the present invention, the diameters of the inscribed-rolling circles of the inner and outer rotors are set to be the same with respect to each other, i.e., $$\varnothing Bo=\varnothing Bi$$

in order to reduce the circumferential clearance between the tooth space of the inner rotor and the tooth tip of the outer rotor.

Due to the above condition, the diameter of the inscribed-rolling circle of the outer rotor becomes greater than in the conventional case (=øBi−t/2); therefore, the diameter of the base circle of the outer rotor becomes greater than in the conventional case (=øDi·(n+1)/n) in order to ensure an appropriate clearance "t", i.e., $$\varnothing Do=\varnothing Di\cdot(n+1)/n+(n+1)\cdot t/(n+2).$$

Because the diameter of the base circle of the outer rotor has been changed, in order to close the rolling distances of the circumscribed-rolling circle and the inscribed-rolling circle, the diameter of the circumscribed-rolling circle of the outer rotor must be adjusted as follows:

$$\varnothing Ao=\varnothing Ai+t/(n+2).$$

According to the present invention, because an appropriate radial clearance is ensured between the external teeth of the inner rotor and the internal teeth of the outer rotor, and the circumferential clearances between the teeth of the rotors are reduced from that in the conventional case, rattle generated between the rotors becomes small, and quietness of the oil pump can be improved.

In the oil pump according to the first and a second aspects of the present invention, the inner rotor and the outer rotor are formed such that the following inequalities are satisfied:

$$0.03 \text{ mm} \leqq t \leqq 0.25 \text{ mm (mm: millimeter).}$$

According to the present invention, because the clearance t is set such that 0.03 mm≦t, pressure pulsation, cavitation noise, and wear of tooth surface are prevented. On the other hand, because the clearance t is set such that t≦0.25 mm, decrease in volumetric efficiency can be prevented.

An oil pump assembly of a third aspect of the present invention comprises: an inner rotor having "n" external teeth; and an outer rotor having (n+1) internal teeth which are engageable with the external teeth, wherein the oil pump rotor assembly is used in an oil pump which further includes a casing having a suction port for drawing fluid and a discharge port for discharging fluid are formed, and which conveys fluid by drawing and discharging fluid by volume change of cells formed between the inner rotor and the outer rotor produced by relative rotation between the inner rotor and the outer rotor engaging each other, wherein each of the tooth profiles of the inner rotor is formed such that the tip profile thereof is formed using an epicycloid curve which is formed by rolling a first circumscribed-rolling circle (Ai) along a base circle (Di) without slip, and the tooth space profile thereof is formed using a hypocycloid curve which is formed by rolling a first inscribed-rolling circle (Bi) along the base circle (Di) without slip, and each of the tooth profiles of the outer rotor is formed such that the tooth space profile thereof is formed using an epicycloid curve which is formed by rolling a second circumscribed-rolling circle (Ao) along a base circle (Do) without slip, and the tip profile thereof is formed using a hypocycloid curve which is formed by rolling a second inscribed-rolling circle (Bo) along the base circle (Do) without slip, and wherein the inner rotor and the outer rotor are formed such that the following equations are satisfied:

$$\phi Ao=\phi Ai;$$

$$\phi Do=\phi Di\cdot(n+1)/n+t\cdot(n+1)/(n+2); \text{ and}$$

$$\phi Bo=\phi Bi+t/(n+2),$$

where øDi is the diameter of the base circle of the inner rotor, øAi is the diameter of the first circumscribed-rolling circle (Ai), øBi is the diameter of the first inscribed-rolling circle (Bi), øDo is the diameter of the base circle of the outer rotor, øAo is the diameter of the second circumscribed-rolling circle (Ao), øBo is the diameter of the second inscribed-rolling circle (Bo), and t (≠0) is gap between the tooth tip of the inner rotor and the tooth tip of the outer rotor.

More specifically, when tooth profiles of the inner and outer rotors are determined, because the sum of the rolling distances of the circumscribed-rolling circle and the inscribed-rolling circle of the inner rotor must be equal to the circumferential length of the base circle thereof, and the sum of the rolling distances of the circumscribed-rolling circle and the inscribed-rolling circle of the outer rotor must be equal to the circumferential length of the base circle thereof, the following equations must be satisfied:

$$\phi Di=n\cdot(\phi Ai+\phi Bi); \text{ and}$$

$$\phi Do=(n+1)\cdot(\phi Ao+\phi Bo).$$

In addition, in the present invention, the diameters of the inscribed-rolling circles of the inner and outer rotors are set to be the same with respect to each other, i.e., $$\phi Ao=\phi Ai$$

in order to reduce the circumferential clearance between the tooth tip of the inner rotor and the tooth space of the outer rotor.

Due to the above condition, the diameter of the circumscribed-rolling circle of the outer rotor becomes greater than in the conventional case (=øAi+t/2); therefore, the diameter of the base circle of the outer rotor becomes greater than in the conventional case (=øDi·(n+1)/n) in order to ensure an appropriate clearance "t", i.e., $$\phi Do=\phi Di\cdot(n+1)/n+(n+1)\cdot t/(n+2).$$

In order to close the rolling distances of the circumscribed-rolling circle and the inscribed-rolling circle, the diameter of the inscribed-rolling circle of the outer rotor must be adjusted as follows:

$$\phi Bo=\phi Bi+t/(n+2).$$

According to the present invention, because an appropriate radial clearance is ensured between the external teeth of the inner rotor and the internal teeth of the outer rotor, and the circumferential clearances between the teeth of the rotors are reduced from that in the conventional case, rattle generated between the rotors becomes small, and quietness of the oil pump can be improved.

In the oil pump according to the third and a fourth aspects of the present invention, the inner rotor and the outer rotor are formed such that the following inequalities are satisfied:

$$0.03 \text{ mm} \leqq t \leqq 0.25 \text{ mm (mm: millimeter).}$$

According to the present invention, because the clearance t is set such that 0.03 mm≦t, pressure pulsation, cavitation noise, and wear of tooth surface are prevented. On the other hand, because the clearance t is set such that t≦0.25 mm, decrease in volumetric efficiency can be prevented.

$$\phi Bo=\phi Bi;$$

$$\phi Do=\phi Di\cdot(n+1)/n+t\cdot(n+1)/(n+2); \text{ and}$$

$$\phi Ao=\phi Ai+t/(n+2),$$

and t is set to be 0.12 mm.

Figure 1:
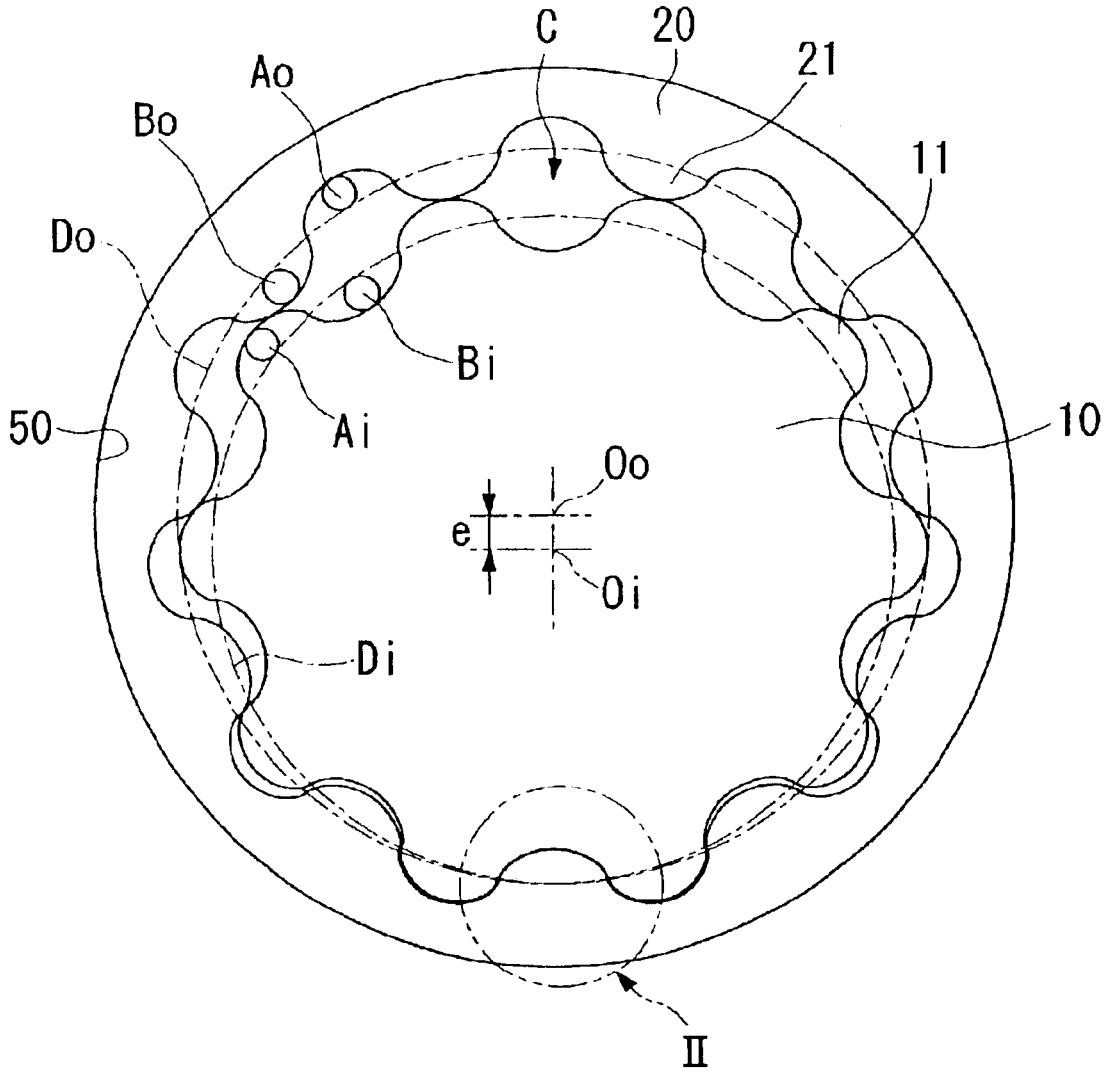
FIG. 1 is a plan view showing an oil pump rotor assembly according to a first embodiment of the present invention in which the inner and outer rotors thereof satisfy the following equations.
Figure 2:
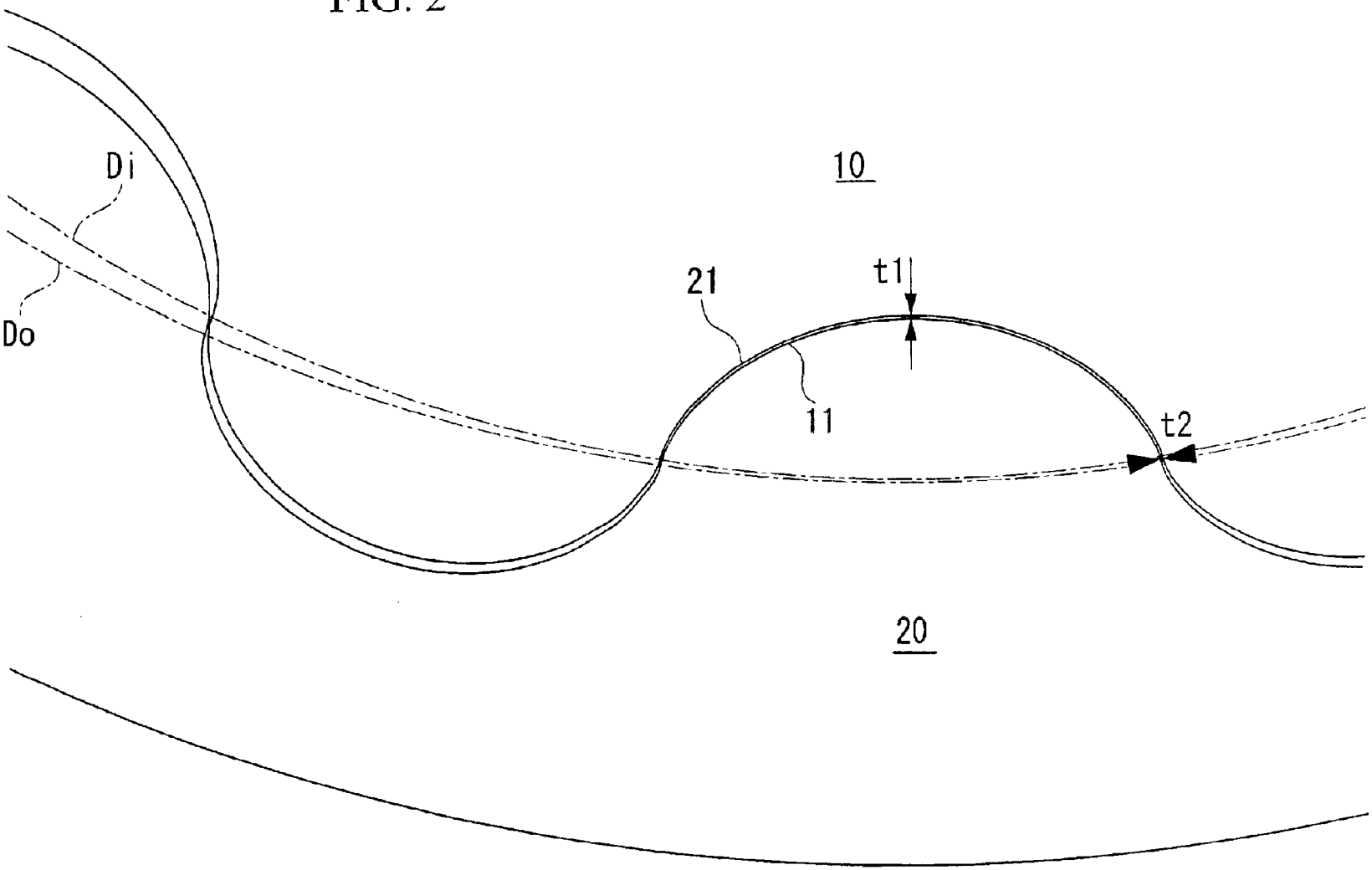

FIG. 2 is an enlarged view showing the engagement region, indicated by II, of the oil pump shown in FIG. 1.

Figure 3:
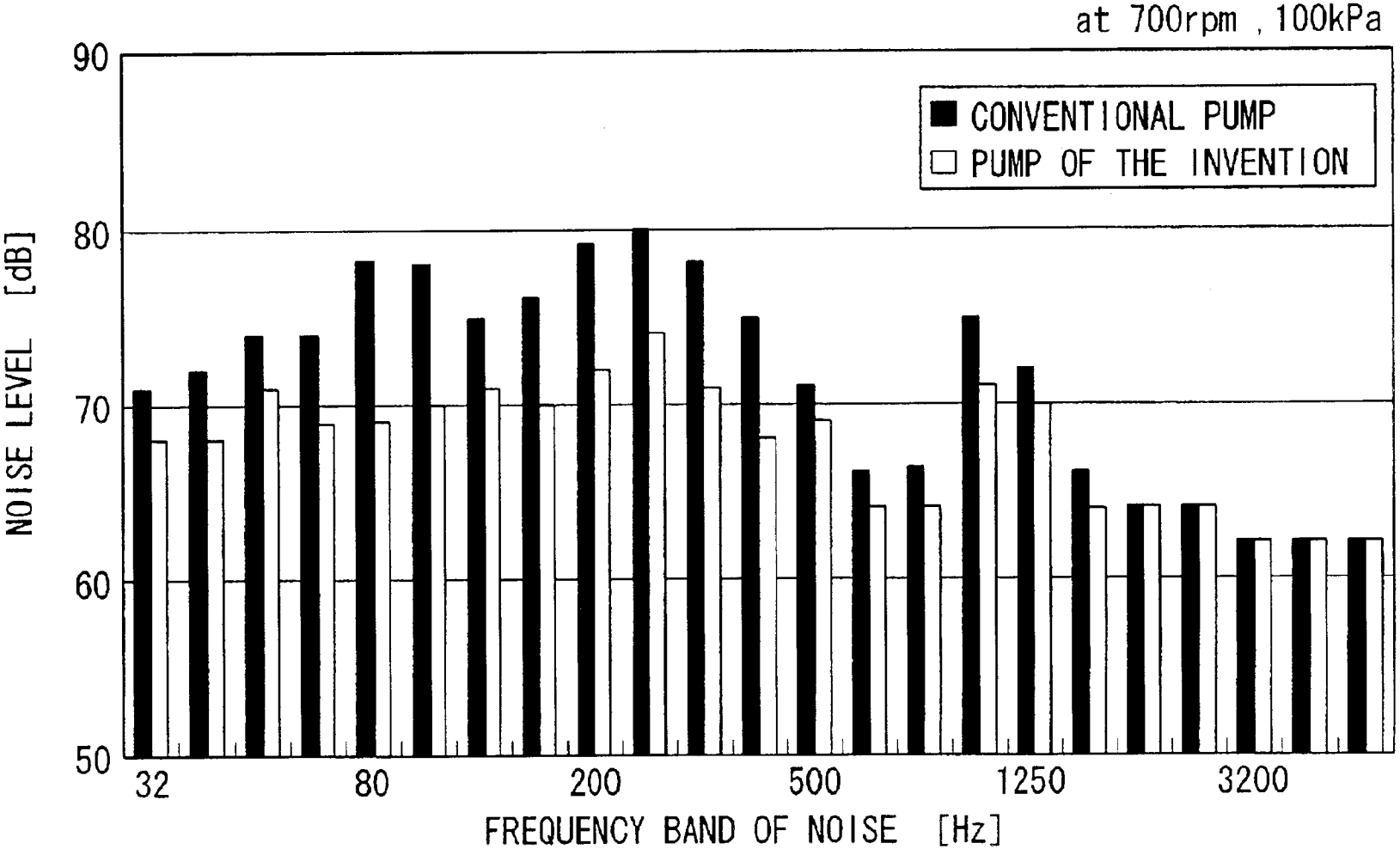

FIG. 3 is a graph showing comparison between noise of the oil pump shown in FIG. 1 and noise of a conventional oil pump.

Figure 4:
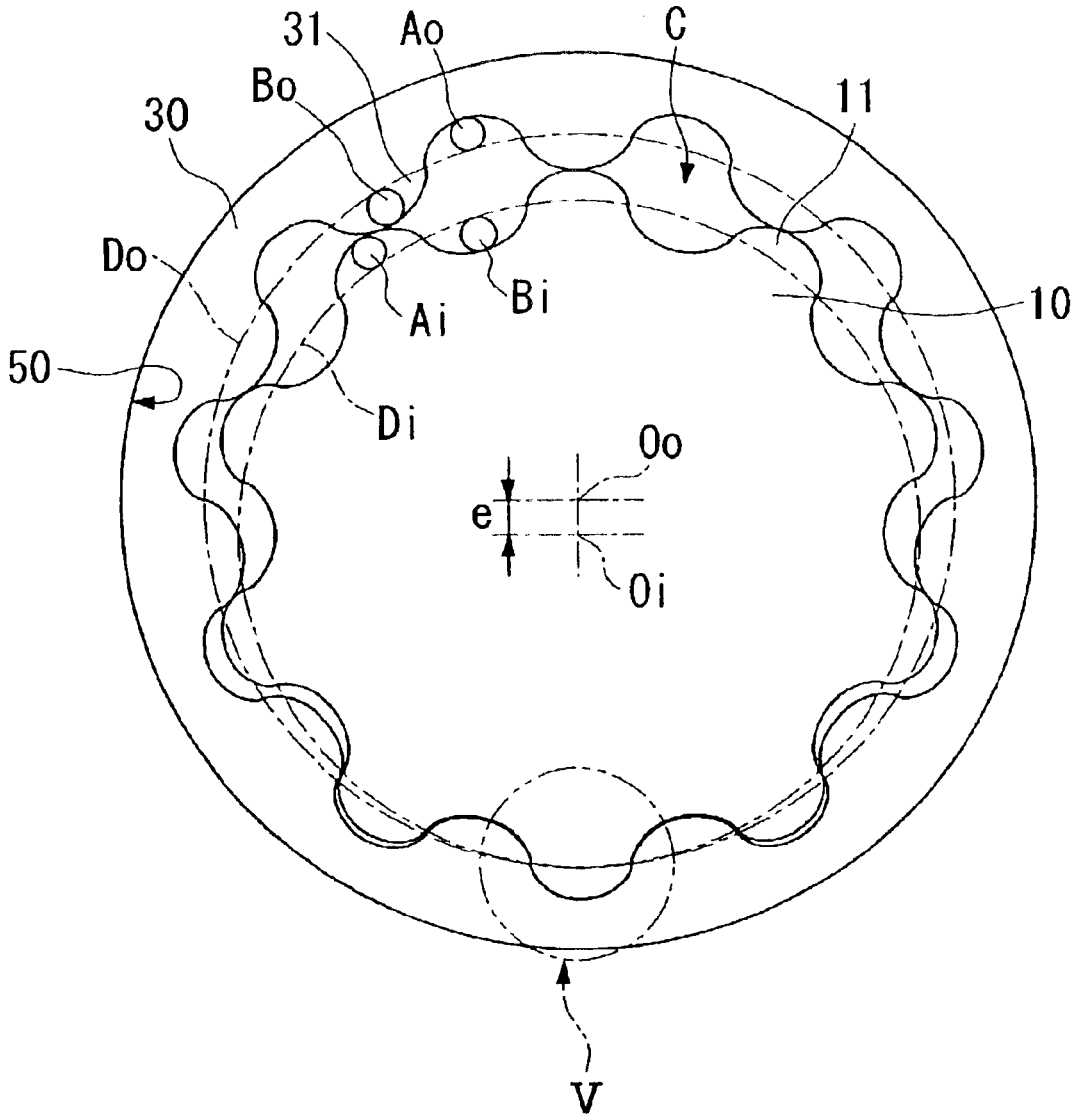

FIG. 4 is a plan view showing an oil pump rotor assembly according to a second embodiment of the present invention in which the inner and outer rotors thereof satisfy the following equations:

$$\phi Ao=\phi Ai;$$

$$\phi Do=\phi Di\cdot(n+1)/n+t\cdot(n+1)/(n+2); \text{ and}$$

$$\phi Bo=\phi Bi+t/(n+2),$$

and t is set to be 0.12 mm.

Figure 5:
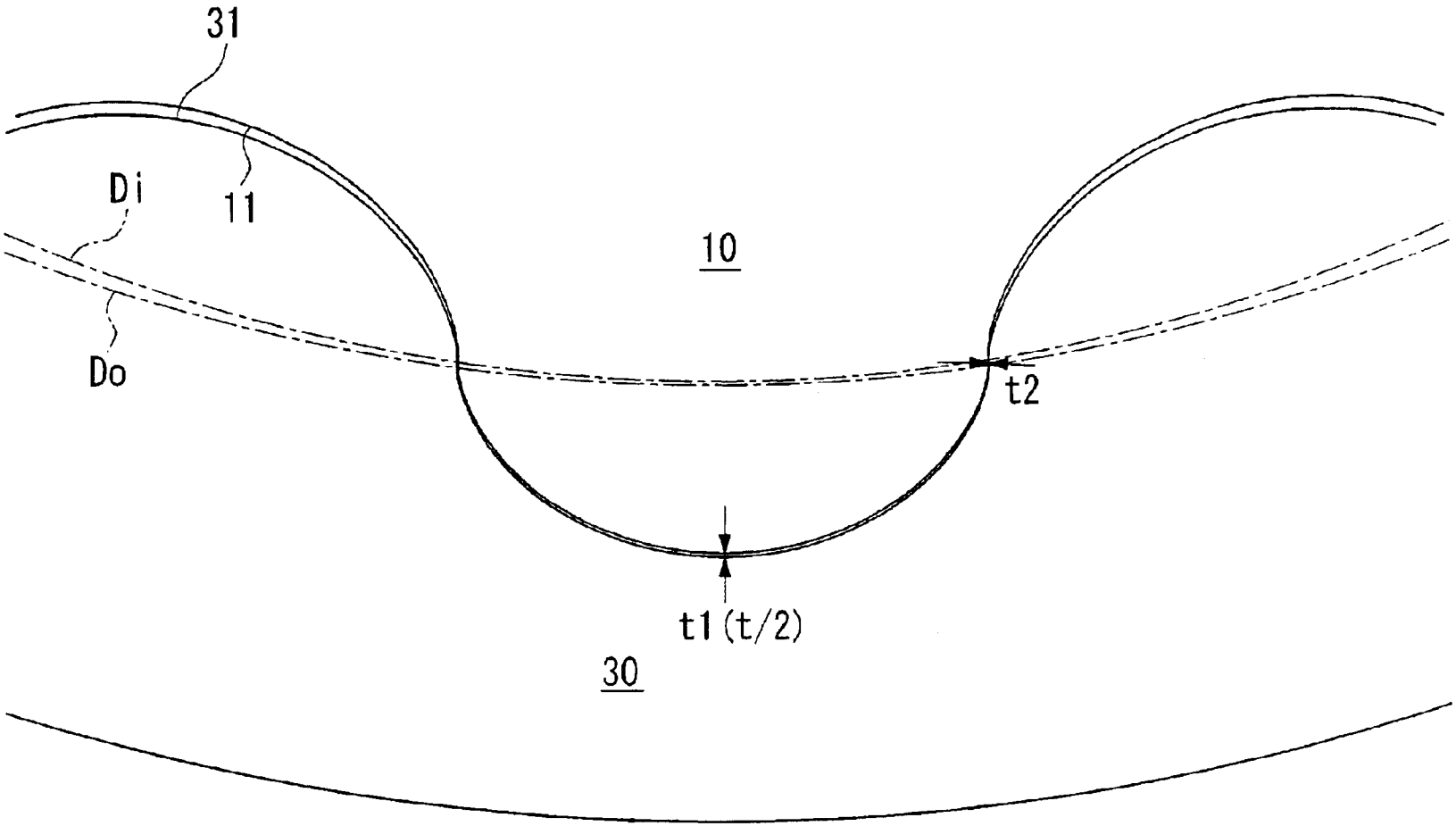

FIG. 5 is an enlarged view showing the engagement region, indicated by V, of the oil pump shown in FIG. 1.

Figure 6:
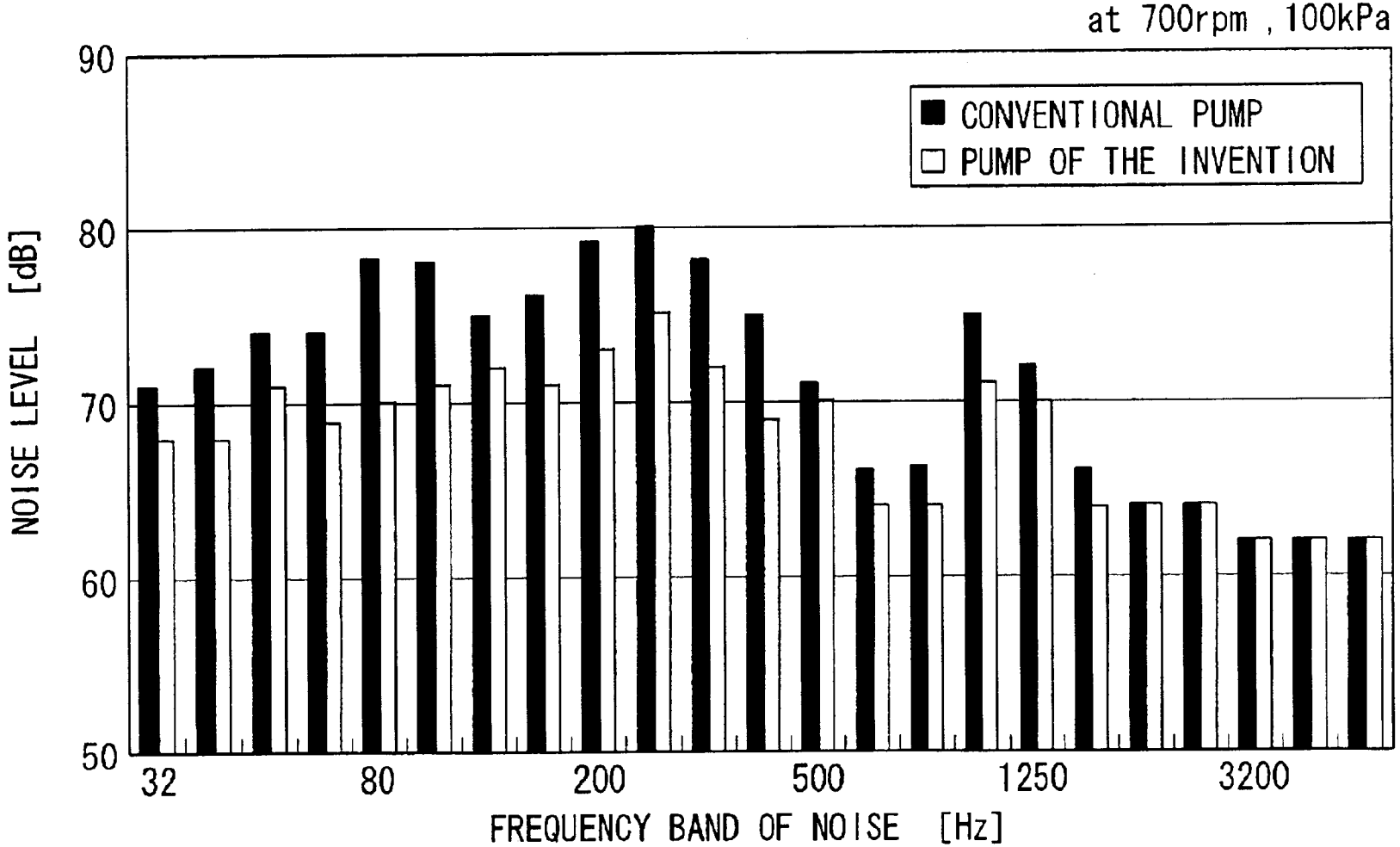

FIG. 6 is a graph showing comparison between noise of the oil pump shown in FIG. 4 and noise of a conventional oil pump.

Figure 7:
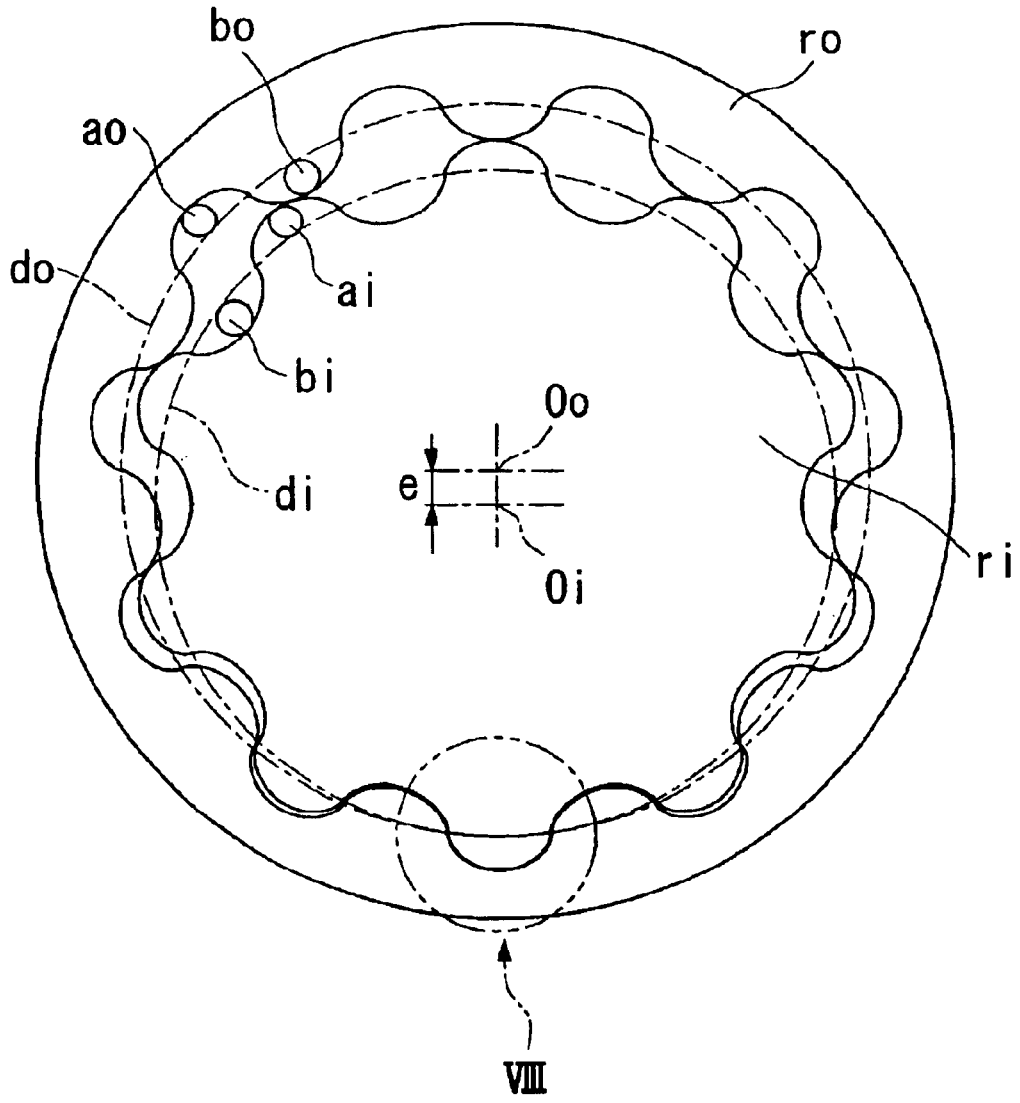
FIG. 7 PRIOR ART

FIG. 7 is a plan view showing a conventional oil pump rotor assembly in which the inner and outer rotors thereof satisfy the following equations:

$$\phi di=n\cdot(\phi ai+\phi bi);$$

$$\phi do=(n+1)\cdot(\phi ao+\phi bo);$$

$$(n+1)\cdot\phi di=n\cdot\phi do;$$

$$\phi ao=\phi ai+s/2; \text{ and}$$

$$\phi bo=\phi bi-s/2,$$

and s is set to be 0.12 mm.

Figure 8:
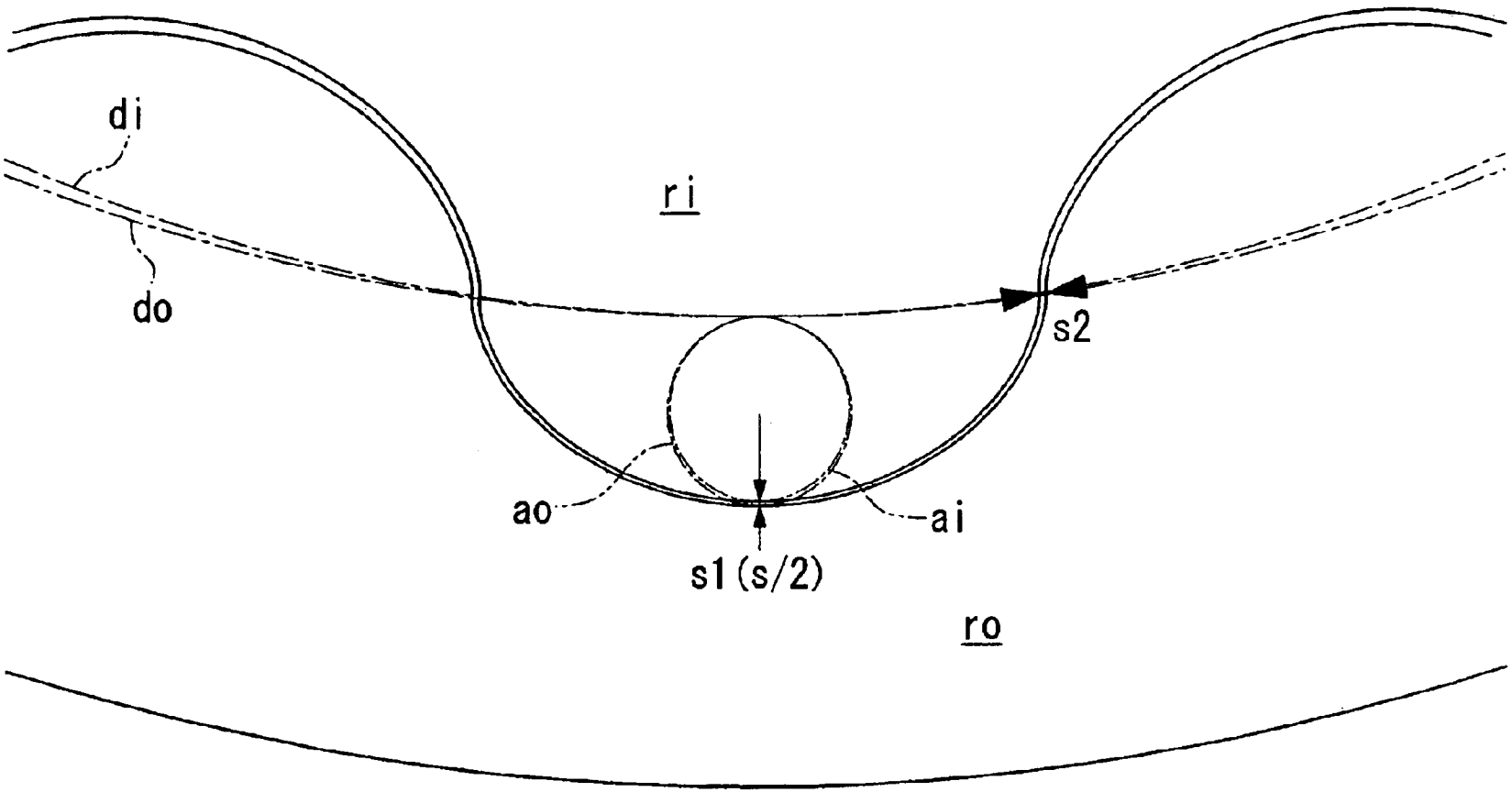
FIG. 8 PRIOR ART

FIG. 8 is an enlarged view showing the engagement region, indicated by VIII, of the oil pump shown in FIG. 7.

Figure 9:
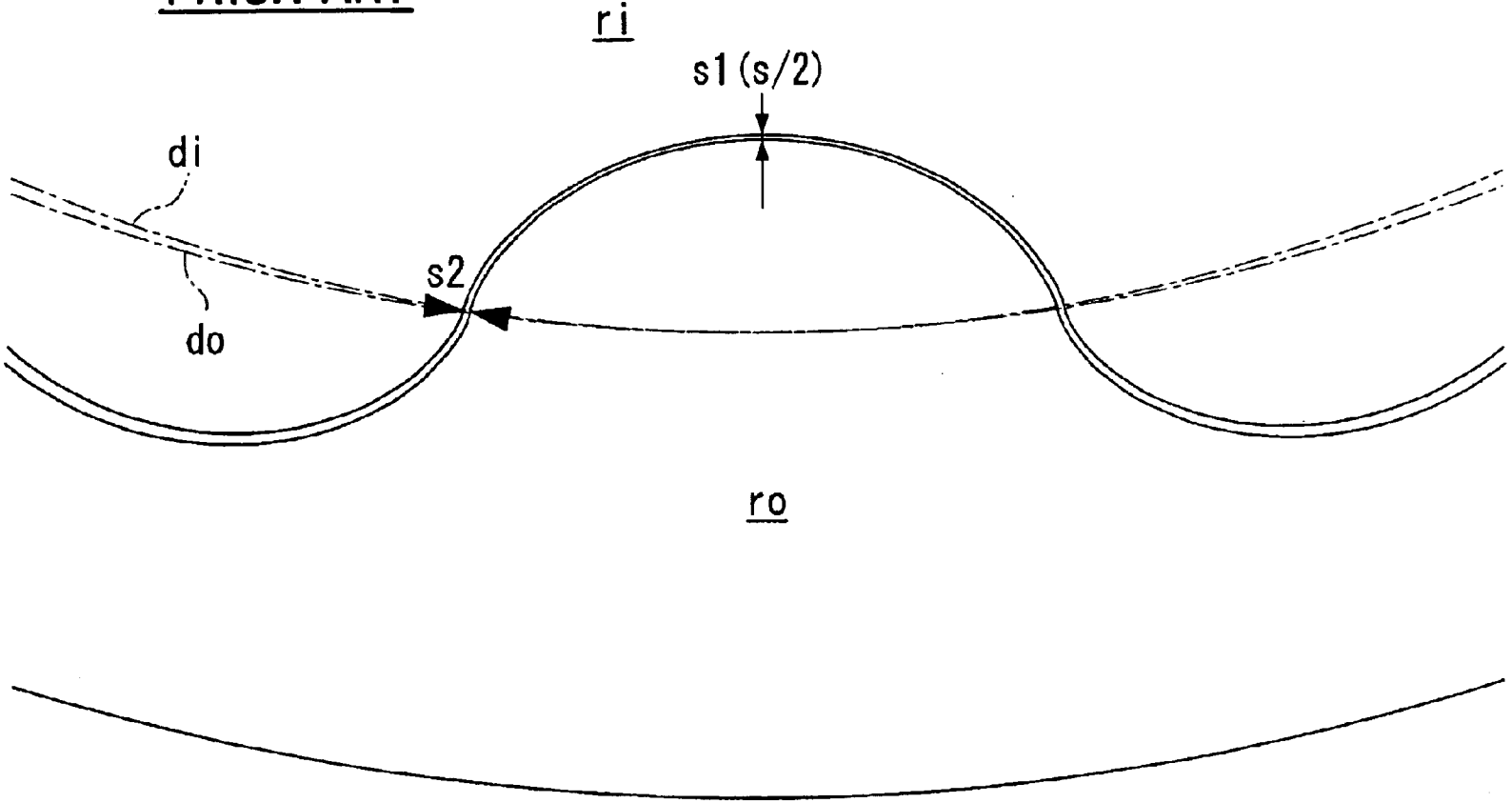
FIG. 9 PRIOR ART

FIG. 9 is an enlarged view showing the engagement region of the oil pump shown in FIG. 7, and specifically showing the engagement state between the tooth tip of the outer rotor and the tooth space of the inner rotor.

DETAILED DESCRIPTION OF THE PREFERRED EMBODIMENTS

A first embodiment of the present invention will be explained below with reference to FIGS. 1 to 3.

The oil pump shown in FIG. 1 comprises an inner rotor 10 provided with "n" external teeth ("n" indicates a natural number, and n=10 in this embodiment), an outer rotor 20 provided with "n+1" internal teeth (n+1=11 in this embodiment) which are engageable with the external teeth, and a casing 50 which accommodates the inner rotor 10 and the outer rotor 20.

Between the tooth surfaces of the inner rotor 10 and outer rotor 20, there are formed a plurality of cells C in the direction of rotation of the inner rotor 10 and outer rotor 20. Each of the cells C is delimited at a front portion and at a rear portion as viewed in the direction of rotation of the inner rotor 10 and outer rotor 20 by contact regions between the external teeth II of the inner rotor 10 and the internal teeth 21 of the outer rotor 20, and is also delimited at either side portions by the casing 50, so that an independent fluid conveying chamber is formed. Each of the cells C moves while the inner rotor 10 and outer rotor 20 rotate, and the volume of each of the cells C cyclically increases and decreases so as to complete one cycle in a rotation.

The inner rotor 10 is mounted on a rotational axis so as to be rotatable about an axis Oi. Each of the tooth profiles of the inner rotor 10 is formed such that the tooth tip profile thereof is formed using an epicycloid curve which is formed by rolling a first circumscribed-rolling circle Ai along a base circle Di of the inner rotor 10 without slip, and the tooth space profile thereof is formed using a hypocycloid curve which is formed by rolling a first inscribed-rolling circle Bi along the base circle Di without slip.

The outer rotor 20 is mounted so as to be rotatable, in the casing 50, about an axis Oo which is disposed so as to have an offset (the eccentric distance is "e") from the axis Oi. Each of the tooth profiles of the outer rotor 20 is formed such that the tooth space profile thereof is formed using an epicycloid curve which is formed by rolling a second circumscribed-rolling circle Ao along a base circle Do of the outer rotor 20 without slip, and the tooth tip profile thereof is formed using a hypocycloid curve which is formed by rolling a second inscribed-rolling circle Bo along the base circle Do without slip.

When the diameter of the base circle Di of the inner rotor 10, the diameter of the first circumscribed-rolling circle Ai, the diameter of the first inscribed-rolling circle Bi, the diameter of the base circle Do of the outer rotor 20, the diameter of the second circumscribed-rolling circle Ao, and the diameter of the second inscribed-rolling circle Bo are assumed to be øDi, øAi, øBi, øDo, øAo, and øBo, respectively, the equations which will be discussed below are to be satisfied between the inner rotor 10 and the outer rotor 20. Note that dimensions will be expressed in millimeters.

First, with regard to the inner rotor 10, because both rolling distance of the first circumscribed-rolling circle Ai and rolling distance of the first inscribed-rolling circle Bi must be closed when each of the rolling circles completes rolling along a base circle, i.e., the length of circumference of the base circle Di of the inner rotor 10 must be equal to the length obtained by multiplying the sum of the rolling distance per revolution of the first circumscribed-rolling circle Ai and the rolling distance of the first inscribed-rolling circle Bi by an integer (i.e., by the number of teeth of the inner rotor 10), $$\pi\cdot øDi=n\cdot\pi\cdot(øAi+øBi),\text{ i.e.,}$$

$$øDi=n\cdot(øAi+øBi) \quad \text{(Ia).}$$

Similarly, with regard to outer rotor 20, the length of circumference of the base circle Do of the outer rotor 20 must be equal to the length obtained by multiplying the sum of the rolling distance per revolution of the second circumscribed-rolling circle Ao and the rolling distance of the second inscribed-rolling circle Bo by an integer (i.e., by the number of teeth of the outer rotor 20), $$\pi\cdot øDo=(n+1)\cdot\pi\cdot(øAo+øBo),\text{ i.e.,}$$

$$øDo=(n+1)\cdot(øAo+øBo) \quad \text{(Ib).}$$

Next, the conditions required for determining tooth profiles of the outer rotor 20 according to this embodiment will be explained below based on the discussion about the outer rotor ro (specifically, the second circumscribed-rolling circle ao (whose diameter is øao), the second inscribed-rolling circle bo (whose diameter is øbo), and the base circle "do" (whose diameter is ødo)).

The outer rotor ro engages the inner rotor 10 according to the present embodiment with a clearance of "t" while being disposed with respect to the inner rotor 10 so as to have an offset (the eccentric distance is "e"), and, as explained above, the following equations are satisfied:

$$ødo=øDi\cdot(n+1)/n \quad \text{(II); and}$$

$$ødo=(n+1)\cdot(øao+øbo) \quad \text{(III)}$$

$$øao=øAi+t/2 \quad \text{(IIIa)}$$

$$øbo=øBi-t/2 \quad \text{(IIIb).}$$

The inner rotor 10 engaging the outer rotor ro satisfies the following generic equations:

$$øai+øbi=øAi+Bi=2e \quad \text{(1); and}$$

$$øDi=ødo-2e \quad \text{(2).}$$

In this embodiment, in order to decrease the circumferential clearances t2 while ensuring the radial clearance t1 between the tooth tip of the outer rotor 20 and the tooth space of the inner rotor 10 in the engagement phase, the diameters are set as follows:

$$øBo=øbi=øBi \quad \text{(IV).}$$

Based on the above equations (IV) and (1), $$øai=øAi \quad \text{(3).}$$

When the inscribed-rolling circle of the outer rotor 20 is set as described above, the clearance "t" which is expressed as t=(øDo−øBo+øAo)−(øDi+øAi+øAi) can be expressed, using the above equations (1) to (3) and (IV), as follows:

$$t=(øDo-ødo)+(øAo-øai) \quad \text{(V).}$$

Based on the above equations (Ib), (III), (IV), and (V), $$t=(øAo-øai)\cdot(n+2) \quad \text{(VI); therefore,}$$

$$øAo=øai+t/(n+2).$$

Next, the diameter øDo of the base circle Do is to be found. Based on the above equations (Ib) and (III), $$øDo-ødo=(n+1)\cdot(øAo+øBo)-(n+1)\cdot(øao+øbo).$$

Furthermore, based on the above equations (IIIa), (IIIb), and (IV), $$øDo-ødo=(n+1)\cdot(øAo-øai) \quad \text{(VII).}$$

By using the equation (VI), the equation (VII) can be expressed as follows:

$$\phi Do-\phi do=(n+1)\cdot t/(n+2).$$

Furthermore, by using the equation (II), øDo can be expressed as follows:

$$\phi Do=(n+1)\cdot\phi Di/n+(n+1)\cdot t/(n+2) \quad \text{(A).}$$

Next, by using the equation (Ib), $$\phi Ao=\phi Do/(n+1)-\phi Bo;$$

therefore, by using the equation (A), $$\phi Ao=\phi Di/n+t/(n+2)-\phi Bo,$$

furthermore, by using the equations (Ia) and (IV), $$\phi Ao=\phi Ai+t/(n+2) \quad \text{(B).}$$

By summarizing the above equations, the outer rotor 20 is formed such that the following equations are satisfied:

$$\phi Bo=\phi bi=\phi Bi \quad \text{(IV);}$$

$$\phi Do=(n+1)\cdot\phi Di/n+(n+1)\cdot t/(n+2) \quad \text{(A); and}$$

$$\phi Ao=\phi Ai+t/(n+2) \quad \text{(B).}$$

FIGS. 1 and 2 show the oil pump rotor assembly in which the inner rotor 10 is formed so as to satisfy the above relationship (the diameter øDi of the base circle Di is 52.00 mm, the diameter øAi of the first circumscribed-rolling circle Ai is 2.50 mm, the diameter øBi of the first inscribed-rolling circle Bi is 2.70 mm, and the number of teeth Zi, i.e., "n" is 10), the outer rotor 20 is formed so as to satisfy the above relationship (the outer diameter thereof is 70 mm, the diameter øDo of the base circle Do is 57.31 mm, the diameter øAo of the second circumscribed-rolling circle Ao is 2.51 mm, and the diameter øBo of the second inscribed-rolling circle Bo is 2.70 mm), and the rotors are combined with the clearance "t" of 0.12 mm, and the eccentric distance "e" of 2.6 mm.

In the casing 50, a suction port having a curved shape (not shown) is formed in a region along which each of the cells C, which are formed between the rotors 10 and 20, moves while gradually increasing the volume thereof, and a discharge port having a curved shape (not shown) is formed in a region along which each of the cells C moves while gradually decreasing the volume thereof.

Each of the cells C draws fluid as the volume thereof increases when the cell C moves over the suction port after the volume of the cell C is minimized in the engagement process between the external teeth 11 and the internal teeth 21, and the cell C discharges fluid as the volume thereof decreases when the cell C moves over the discharge port after the volume of the cell C is maximized.

Note that if the clearance "t" is too small, pressure pulsation is generated in fluid being discharged from the cell C whose volume is decreasing, which leads to generation of cavitation noise, whereby operation noise of the pump is increased. Moreover, the rotors may not smoothly rotate due to the pressure pulsation.

On the other hand, if the clearance "t" is too large, pressure pulsation is not generated, operation noise is decreased, and sliding resistance between the tooth surfaces is decreases due to a large backlash, whereby mechanical efficiency is improved; however, the fluidtight performance of each of the cells is degraded, and performance of the pump, specifically, the volume efficiency thereof is degraded. Moreover, because transmission of driving torque in accurately engaged positions is not achieved, and loss in rotation is increased, and finally, mechanical efficiency is degraded.

To prevent the above problems, the clearance "t" is preferably set so as to satisfy the following inequalities:

$$0.03\ \text{mm} \leqq t \leqq 0.25\ \text{mm}.$$

In this embodiment, the clearance "t" is set to be 0.12 mm, which is considered to be the most preferable.

In the oil pump rotor assembly formed in such a manner that the above equations (IV), (A), and (B) are satisfied, the profile of the tooth tip of the outer rotor 20 and the profile of the tooth space of the inner rotor 10 have substantially the same shape with respect to each other, as shown in FIG. 2. As a result, as shown in FIG. 2, the circumferential clearances t2 in the engagement phase can be decreased while ensuring the radial clearance t1 such that t/2is 0.06 mm, which is the same as in conventional rotors; therefore, engagement impacts between the rotors 10 and 20 during rotation are decreased. Furthermore, because the direction along which engagement pressure is transmitted perpendicularly to the tooth surfaces, transmission of torque between the rotors 10 and 20 is performed with high efficiency without slip, and heat generation and noise due to sliding resistance can be reduced.

FIG. 3 is a graph showing comparison between noise of a pump incorporating a conventional oil pump rotor assembly and noise of another pump incorporating the oil pump rotor assembly according to the present embodiment. According to the graph, noise of the oil pump rotor assembly of the present embodiment is less than that of the conventional oil pump rotor assembly, i.e., the oil pump rotor assembly of the present embodiment is quieter.

As explained above, according to the oil pump rotor assembly of the present invention, by setting the diameter of the inscribed-rolling circle of the outer rotor to be the same as that of the inscribed-rolling circle of the inner rotor, the circumferential clearances can be decreased to be less than in conventional rotors while ensuring the radial clearance; therefore, play between the rotors can be reduced, and a quiet oil pump can be made.

Moreover, according to the oil pump rotor assembly of the present invention, by setting the clearance "t" as 0.03 mm≦t, pressure pulsation, cavitation noise, and wear of teeth can be prevented, and by setting the clearance "t" as t≦0.25 mm, decrease in the volume efficiency of the pump can be prevented.

Next, a second embodiment of the present invention will be explained below with reference to FIGS. 4 to 6.

The oil pump shown in FIG. 4 comprises an inner rotor 10 provided with "n" external teeth ("n" indicates a natural number, and n=10 in this embodiment), an outer rotor 30 provided with "n+1" internal teeth (n+1=11 in this embodiment) which are engageable with the external teeth, and a casing 50 which accommodates the inner rotor 10 and the outer rotor 30.

Between the tooth surfaces of the inner rotor 10 and outer rotor 30, there are formed a plurality of cells C in the direction of rotation of the inner rotor 10 and outer rotor 30. Each of the cells C is delimited at a front portion and at a rear portion as viewed in the direction of rotation of the inner rotor 10 and outer rotor 30 by contact regions between the external teeth 11 of the inner rotor 10 and the internal teeth 31 of the outer rotor 30, and is also delimited at either side portions by the casing 50, so that an independent fluid conveying chamber is formed. Each of the cells C moves while the inner rotor 10 and outer rotor 30 rotate, and the volume of each of the cells C cyclically increases and decreases so as to complete one cycle in a rotation.

The inner rotor 10 is mounted on a rotational axis so as to be rotatable about an axis Oi. Each of the tooth profiles of the inner rotor 10 is formed such that the tooth tip profile thereof is formed using an epicycloid curve which is formed by rolling a first circumscribed-rolling circle Ai along a base circle Di of the inner rotor 10 without slip, and the tooth space profile thereof is formed using a hypocycloid curve which is formed by rolling a first inscribed-rolling circle Bi along the base circle Di without slip.

The outer rotor 30 is mounted so as to be rotatable, in the casing 50, about an axis Oo which is disposed so as to have an offset (the eccentric distance is "e") from the axis Oi. Each of the tooth profiles of the outer rotor 30 is formed such that the tooth space profile thereof is formed using an epicycloid curve which is formed by rolling a second circumscribed-rolling circle Ao along a base circle Do of the outer rotor 30 without slip, and the tooth tip profile thereof is formed using a hypocycloid curve which is formed by rolling a second inscribed-rolling circle Bo along the base circle Do without slip.

When the diameter of the base circle Di of the inner rotor 10, the diameter of the first circumscribed-rolling circle Ai, the diameter of the first inscribed-rolling circle Bi, the diameter of the base circle Do of the outer rotor 30, the diameter of the second circumscribed-rolling circle Ao, and the diameter of the second inscribed-rolling circle Bo are assumed to be øDi, øAi, øBi, øDo, øAo, and øBo, respectively, the following equations are to be satisfied between the inner rotor 10 and the outer rotor 30, and the outer rotor 30 is so as to satisfy the following equations:

$$øAo=øai=øAi \quad \text{(I);}$$

$$øDo=(n+1)\cdot øDi/n+(n+1)\cdot t/(n+2) \quad \text{(II); and}$$

$$øBo=øBi+t/(n+2) \quad \text{(III).}$$

Note that dimensions will be expressed in millimeters.

FIG. 4 shows the oil pump rotor assembly in which the inner rotor 10 is formed so as to satisfy the above relationship (the diameter øDi of the base circle Di is 52.00 mm, the diameter øAi of the first circumscribed-rolling circle Ai is 2.50 mm, the diameter øBi of the first inscribed-rolling circle Bi is 2.70 mm, and the number of teeth Zi, i.e., "n" is 10), the outer rotor 30 is formed so as to satisfy the above relationship (the outer diameter thereof is 70 mm, the diameter øDo of the base circle Do is 57.31 mm, the diameter øAo of the second circumscribed-rolling circle Ao is 2.50 mm, and the diameter øBo of the second inscribed-rolling circle Bo is 2.71 mm), and the rotors are combined with the clearance "t" of 0.12 mm, and the eccentric distance "e" of 2.6 mm.

In the casing 50, a suction port having a curved shape (not shown) is formed in a region along which each of the cells C, which are formed between the rotors 10 and 30, moves while gradually increasing the volume thereof, and a discharge port having a curved shape (not shown) is formed in a region along which each of the cells C moves while gradually decreasing the volume thereof.

Each of the cells C draws fluid as the volume thereof increases when the cell C moves over the suction port after the volume of the cell C is minimized in the engagement process between the external teeth 11 and the internal teeth 31, and the cell C discharges fluid as the volume thereof decreases when the cell C moves over the discharge port after the volume of the cell C is maximized.

Note that if the clearance "t" is too small, pressure pulsation is generated in fluid being discharged from the cell C whose volume is decreasing, which leads to generation of cavitation noise, whereby operation noise of the pump is increased. Moreover, the rotors may not smoothly rotate due to the pressure pulsation.

On the other hand, if the clearance "t" is too large, pressure pulsation is not generated, operation noise is decreased, and sliding resistance between the tooth surfaces is decreases due to a large backlash, whereby mechanical efficiency is improved; however, the fluidtight performance of each of the cells is degraded, and performance of the pump, specifically, the volume efficiency thereof is degraded. Moreover, because transmission of driving torque in accurately engaged positions is not achieved, and loss in rotation is increased, finally, mechanical efficiency is degraded.

To prevent the above problems, the clearance "t" is preferably set so as to satisfy the following inequalities:

$$0.03 \text{ mm} \leqq t \leqq 0.25 \text{ mm.}$$

In this embodiment, the clearance "t" is set to be 0.12 mm, which is considered to be the most preferable.

In the oil pump rotor assembly formed in such a manner that the above equations (I), (II), and (III) are satisfied, the profile of the tooth tip of the outer rotor 30 and the profile of the tooth space of the inner rotor 10 have substantially the same shape with respect to each other as shown in FIG. 5. As a result, as shown in FIG. 5, the circumferential clearances t2 in the engagement phase can be decreased while ensuring the radial clearance t1; therefore, engagement impacts between the rotors 10 and 30 during rotation are decreased. Furthermore, because the direction along which engagement pressure is transmitted is perpendicular to the tooth surfaces, transmission of torque between the rotors 10 and 30 is performed with high efficiency without slip, and heat generation and noise due to sliding resistance can be reduced.

FIG. 6 is a graph showing comparison between noise of a pump incorporating a conventional oil pump rotor assembly and noise of another pump incorporating the oil pump rotor assembly according to the present embodiment. According to the graph, noise of the oil pump rotor assembly of the present embodiment is less than that of the conventional oil pump rotor assembly, i.e., the oil pump rotor assembly of the present embodiment is quieter.

As explained above, according to the oil pump rotor assembly of the present invention, by setting the diameter of the circumscribed-rolling circle of the outer rotor to be the same as that of the circumscribed-rolling circle of the inner rotor, by setting the diameter of the inscribed-rolling circles of the inner and outer rotors to be different from the diameter of either circumscribed-rolling circle of the inner and outer rotors, and by adjusting the diameter of the base circle of the outer rotor, the circumferential clearances can be decreased to be less than in conventional rotors while ensuring the radial clearance; therefore, play between the rotors can be reduced, and a quiet oil pump can be formed.

Moreover, according to the oil pump rotor assembly of the present invention, by setting the clearance "t" as 0.03 mm≦t, pressure pulsation, cavitation noise, and wear of teeth can be prevented, and by setting the clearance "t" as t≦0.25 mm, decrease in the volume efficiency of the pump can be prevented.

What is claimed is:

1. An oil pump rotor assembly comprising:

an inner rotor having "n" external teeth; and an outer rotor having (n+1) internal teeth which are engageable with the external teeth, wherein each of the tooth profiles of the inner rotor is formed such that the tip profile thereof is formed using an epicycloid curve which is formed by rolling a first circumscribed-rolling circle along a base circle without slip, and the tooth space profile thereof is formed using a hypocycloid curve which is formed by rolling a first inscribed-rolling circle along the base circle without slip, and each of the tooth profiles of the outer rotor is formed such that the tooth space profile thereof is formed using an epicycloid curve which is formed by rolling a second circumscribed-rolling circle along a base circle without slip, and the tip profile thereof is formed using a hypocycloid curve which is formed by rolling a second inscribed-rolling circle along the base circle without slip, and wherein the inner rotor and the outer rotor are formed such that the following equations are satisfied:

$$øB=øBi;$$

$$øDo=øDi\cdot(n+1)/n+t\cdot(n+1)/(n+2); \text{ and}$$

$$øi\ Ao=øAi+t/(n+2),$$

where øDi is the diameter of the base circle of the inner rotor, øAi is the diameter of the first circumscribed-rolling circle, øBi is the diameter of the first inscribed-rolling circle, øDo is the diameter of the base circle of the outer rotor, øAo is the diameter of the second circumscribed-rolling circle, øBo is the diameter of the second inscribed-rolling circle, and t (≠0) is gap between the tooth tip of the inner rotor and the tooth tip of the outer rotor.

2. An oil pump rotor assembly according to claim 1, wherein the inner rotor and the outer rotor are formed such that the following inequalities are satisfied:

$$0.03\ \text{mm} \leqq t \leqq 0.25\ \text{mm (mm: millimeter).}$$

3. An oil pump rotor assembly comprising:

an inner rotor having "n" external teeth; and an outer rotor having (n+1) internal teeth which are engageable with the external teeth, wherein each of the tooth profiles of the inner rotor is formed such that the tip profile thereof is formed using an epicycloid curve which is formed by rolling a first circumscribed-rolling circle along a base circle without slip, and the tooth space profile thereof is formed using a hypocycloid curve which is formed by rolling a first inscribed-rolling circle along the base circle without slip, and each of the tooth profiles of the outer rotor is formed such that the tooth space profile thereof is formed using an epicycloid curve which is formed by rolling a second circumscribed-rolling circle along a base circle without slip, and the tip profile thereof is formed using a hypocycloid curve which is formed by rolling a second inscribed-rolling circle along the base circle without slip, and wherein the inner rotor and the outer rotor are formed such that the following equations are satisfied:

$$øAo=øAi;$$

$$øDo=øDi\cdot(n+1)/n+t\cdot(n+1)/(n+2); \text{ and}$$

$$øBo=øBi+t/(n+2),$$

where øDi is the diameter of the base circle of the inner rotor, øAi is the diameter of the first circumscribed-rolling circle, øBi is the diameter of the first inscribed-rolling circle, øDo is the diameter of the base circle of the outer rotor, øAo is the diameter of the second circumscribed-rolling circle, øBo is the diameter of the second inscribed-rolling circle, and t (≠0) is gap between the tooth tip of the inner rotor and the tooth tip of the outer rotor.

4. An oil pump rotor assembly according to claim 3, wherein the inner rotor and the outer rotor are formed such that the following inequalities are satisfied:

$$0.03\ \text{mm} \leqq t \leqq 0.25\ \text{mm (mm: millimeter).}$$

* * * * *